US007087869B2

(12) United States Patent
Eguchi et al.

(10) Patent No.: US 7,087,869 B2
(45) Date of Patent: Aug. 8, 2006

(54) TRANSVERSE INDUCTION HEATING APPARATUS

(75) Inventors: Toshinobu Eguchi, Tokyo (JP); Hideo Sakamoto, Tokyo (JP); Norihiro Saijou, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/519,111

(22) PCT Filed: Mar. 25, 2004

(86) PCT No.: PCT/JP2004/004174

§ 371 (c)(1),
(2), (4) Date: Dec. 23, 2004

(87) PCT Pub. No.: WO2004/089041

PCT Pub. Date: Oct. 14, 2004

(65) Prior Publication Data

US 2005/0247702 A1 Nov. 10, 2005

(30) Foreign Application Priority Data

Mar. 31, 2003 (JP) ..... 2003-095010

(51) Int. Cl.
*H05B 6/10* (2006.01)
*B21B 45/00* (2006.01)
*H05B 6/06* (2006.01)

(52) U.S. Cl. ..... 219/602; 219/645; 219/646; 219/670; 219/655; 219/676; 266/129; 148/572

(58) Field of Classification Search ..... 219/645–646, 219/602, 656, 660–663, 655, 670–672, 676; 148/566–576; 266/129
See application file for complete search history.

(56) References Cited

U.S. PATENT DOCUMENTS 2,477,411 A * 7/1949 King ..... 219/602
5,990,464 A 11/1999 Hino et al.

FOREIGN PATENT DOCUMENTS

| | | |
|---|---|---|
| DE | 26-12153 | 10/1976 |
| JP | 52-030935 | 3/1977 |
| JP | 53-001339 | 1/1978 |
| JP | 58-032383 | 2/1983 |
| JP | 63-128580 | 6/1988 |
| JP | 01-321009 | 12/1989 |
| JP | 60-38563 | 2/1994 |
| JP | 10-094818 | 4/1998 |
| JP | 11-169910 | 6/1999 |
| JP | 2003-082412 | 3/2003 |

* cited by examiner

*Primary Examiner*—Philip H. Leung
(74) *Attorney, Agent, or Firm*—Leydig, Voit & Mayer, Ltd.

(57) ABSTRACT

In a transverse induction heating apparatus in which a material to be rolled is heated by inductors to which electric power is supplied from an AC power source, iron core widths of the inductors in a plate width direction of the material to be rolled are smaller than plate width of the material to be rolled, they are disposed on a plate width center line of the material to be rolled, and when a current penetration depth is δ(m), specific resistance of the material to be rolled is ρ(Ω-m), magnetic permeability of the material to be rolled is μ(H/m), heating frequency of the AC power source is f (Hz), and plate thickness of the material to be rolled is tw (m), the heating frequency of the AC power source is set so that $$\delta=\{\rho/(\mu \cdot f \cdot \pi)\}^{1/2} \text{ and } (tw/\delta)<0.95.$$

15 Claims, 11 Drawing Sheets

12,13 : LIFTING AND LOWERING MEANS

1: MATERIAL TO BE ROLLED
2, 3: INDUCTOR
2a, 3a: IRON CORE
2b, 3b: COIL 7a, 7b: CONVEYING ROLL
8: MATERIAL TO BE ROLLED
9, 10: INDUCTOR
9a, 10a: IRON CORE
9b, 9c,10a,10b,10c: COIL 12,13 : LIFTING AND LOWERING MEANS

17: MATERIAL TO BE ROLLED
18a: CONVEYING ROLL
18b: CONVEYING ROLL
18c: CONVEYING ROLL
19, 20: INDUCTION HEATING APPARATUS
19a, 20a: INDUCTOR

TRANSVERSE INDUCTION HEATING APPARATUS

TECHNICAL FIELD

The present invention relates to a transverse induction heating apparatus disposed in a hot-rolling steel production line.

BACKGROUND ART

In a conventional solenoid type induction heating apparatus, although only a surface has a high temperature by a skin effect, a specified time is taken so that heat energy is sufficiently diffused into the inside of a plate and the temperature of the surface becomes lower than that at the center in plate thickness, and a temperature distribution in a plate thickness direction becomes appropriate.

For example, see JP-A-10-128424 (page 5, FIG. 1).

Further, in a transverse type induction heating apparatus, at the inlet side of a finish rolling mill, an inductor is moved in the width direction of a front edge part or a tail edge part of a material to be rolled so that the whole range of the material to be rolled is heated, and the inductor is moved to an edge part in the width direction of the material to be rolled so that the edge part in the width direction is continuously heated.

For example, see JP-A-1-321009 (page 3, FIG. 1).

In the conventional solenoid type induction heating apparatus, as a heating frequency becomes high, an induced current concentrate on the surface of the material to be rolled and flows, and the excessive temperature rise of the surface becomes large.

Besides, as the plate thickness becomes large, the excessive temperature rise of the surface with respect to the inside becomes large.

Thus, there has been a problem that it becomes necessary to take a sufficient time to make the temperature distribution in the plate thickness direction appropriate.

Further, in the transverse type, its object is to heat only the edge part of the material to be rolled in the plate width direction, the front edge part of the plate, and the tail edge part, and the inductor is moved to the center part in the plate width in order to heat the plate front edge part and the plate tail edge part in the plate width direction, and therefore, there has been a problem that the plate width center part of the material to be rolled can not be continuously heated in the longitudinal direction.

DISCLOSURE OF THE INVENTION

This invention has been made to solve the problems as described above, and has an object to provide a transverse type induction heating apparatus which continuously heats a plate width center part of a material to be rolled in its longitudinal direction, and can prevent a surface of the material to be rolled from having an excessive temperature rise.

According to a transverse type induction heating apparatus of this invention, in the transverse type induction heating apparatus in which inductors are disposed to be opposite to each other across a material to be rolled, and the material to be rolled, which is conveyed by a conveying roll, is heated by the inductors to which electric power is supplied from an AC power source, iron core widths of the inductors in a plate width direction of the material to be rolled are made smaller than a plate width of the material to be rolled, they are disposed on a plate width center line of the material to be rolled, and when a current penetration depth is made $\delta$(m), a specific resistance of the material to be rolled is made $\rho$($\Omega$-m), a magnetic permeability of the material to be rolled is made $\mu$(H/m), a heating frequency of the AC power source is made f (Hz), a circular constant is made $\pi$, and a plate thickness of the material to be rolled is made tw (m), the heating frequency of the AC power source is set to cause the current penetration depth $\delta$ of expression (1) set forth below to satisfy expression (2) set forth below $$\delta = \sqrt{\frac{\rho}{\mu \cdot f \cdot \pi}} \tag{1}$$

$$\frac{tw}{\delta} < 0.95. \tag{2}$$

BEST MODE FOR CARRYING OUT THE INVENTION

Embodiment 1

Figure 1A:
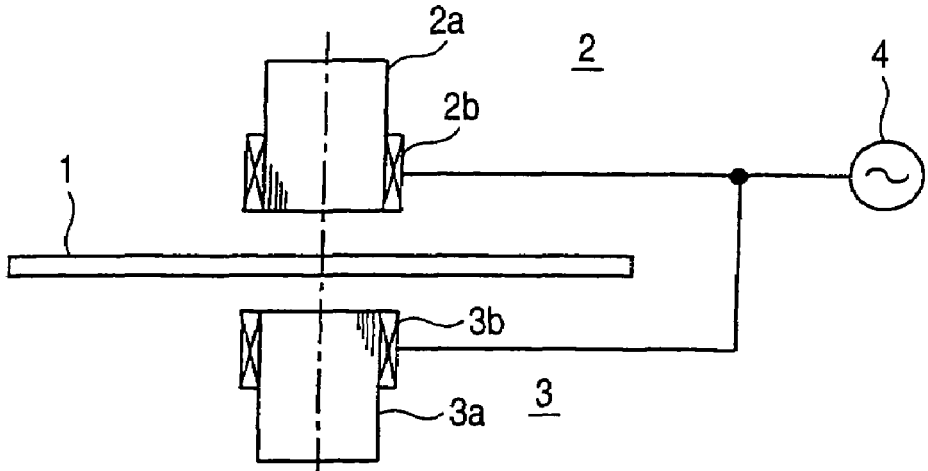
FIG. 1A is a structural view of a transverse induction heating apparatus and FIG. 1B is a temperature distribution graph according to embodiment 1 of this invention.
Figure 1B:
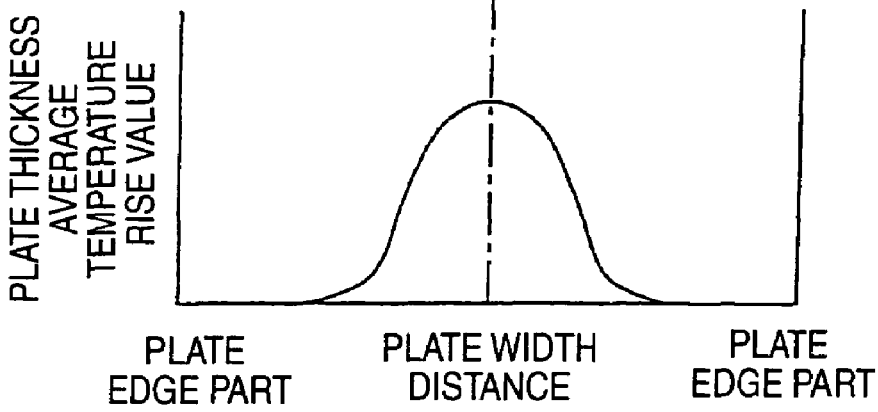
Figure 2:
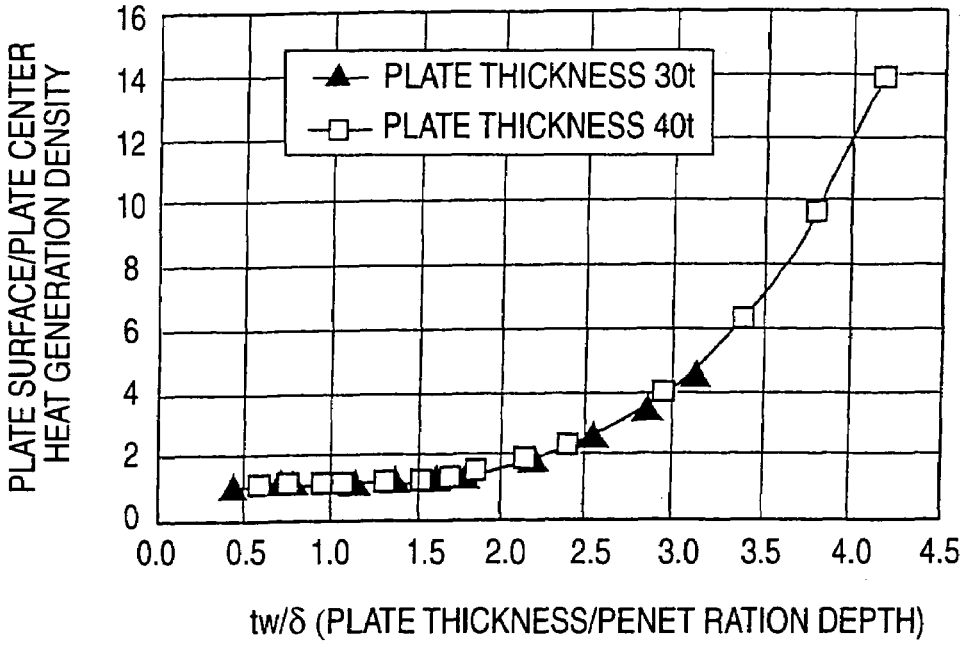
FIG. 2 is a graph showing a relationship between a ratio of (plate thickness)/(penetration depth) and a ratio of (plate surface)/(plate center heat generation density) for FIG. 1A.
Figure 3:
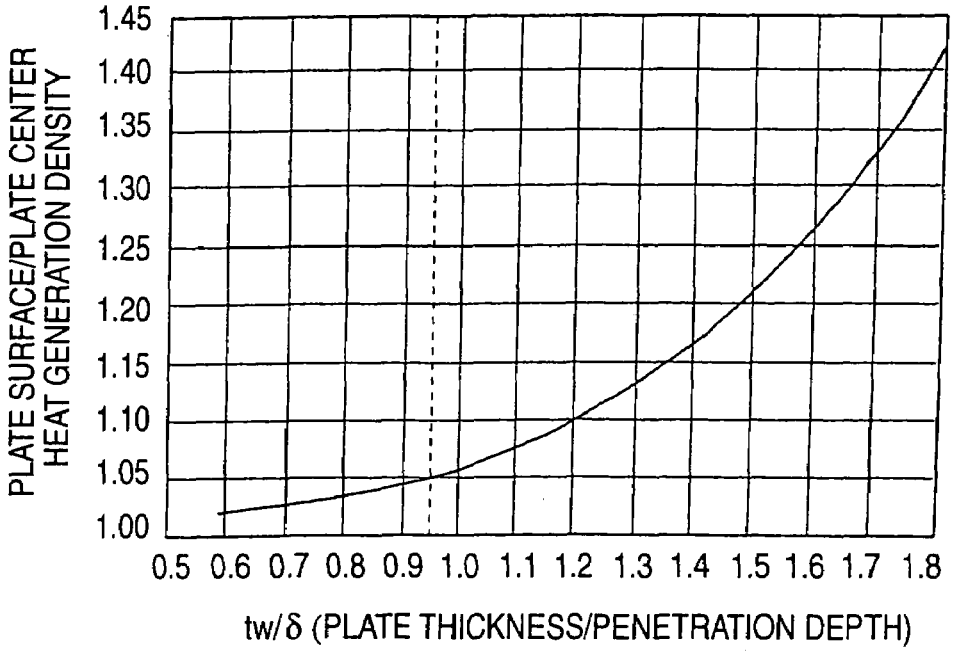
FIG. 3 is a graph obtained by enlarging FIG. 2.

FIG. 1A is a structural view of a transverse induction heating apparatus according to embodiment 1 of this invention, FIG. 2 is a graph showing a relationship between a ratio of (plate thickness)/(penetration depth) and a ratio of (plate surface)/(plate center heat generation density) in FIG. 1, and FIG. 3 is a graph obtained by enlarging FIG. 2.

In FIGS. 1A to 3, a material 1 to be rolled is conveyed by a conveying roll (not shown) between a rough rolling mill (not shown) of a steel hot-rolling line and a finish rolling mill (not shown).

A pair (a set) of inductors 2 and 3 are disposed vertically to be opposite to each other across the material 1 to be rolled. The inductors 2 and 3 are respectively constructed of iron cores 2*a* and 3*a* whose iron core widths in a plate width direction of the material 1 to be rolled are smaller than a plate width of the material 1 to be rolled and coils 2*b* and coils 3*b* wound around the iron cores 2*a* and 3*a*.

High frequency electric power is supplied to the respective coils 2*b* and 3*b* from an AC power source 4, and the material 1 to be rolled is induction heated by magnetic fluxes generated from the iron cores 2*a* and 3*a*.

Although the iron core width of the inductor 2, 3 is determined according to a heating pattern, it has been confirmed experimentally that the iron core width is made not larger than a value obtained by subtracting 300 mm from the plate width of the material 1 to be rolled, and the inductors 2 and 3 are disposed on a plate width center line of the material 1 to be rolled, so that an excessive temperature rise at a plate width edge part is almost eliminated, and a plate width center part is heated as shown in FIG. 1B.

Here, that the inductors 2 and 3 are disposed on the center line of the material 1 to be rolled means that in addition to disposing the inductors 2 and 3 so that their centers are coincident with the plate width center line, the inductors 2 and 3 are disposed at the center part in the plate width so that part of the iron cores 2*a* and 3*a* exist on the plate width center line.

In the steel hot-rolling line, the plate width of the material 1 to be rolled is 600 to 1900 mm and its range is large. Accordingly, it is appropriate that the iron core widths of the iron cores 2*a* and 3*a* of the inductors 2 and 3 are set in the range of 300 to 700 mm.

Expression (1) indicates a computation expression of a current penetration depth δ(m) by induction heating.

$$\delta = \sqrt{\frac{\rho}{\mu \cdot f \cdot \pi}} \tag{1}$$

Here, ρ denotes a specific resistance (Ω-m) of the material 1 to be rolled, μ denotes a magnetic permeability (H/m) of the material 1 to be rolled, f denotes a heating frequency (Hz) of the AC power source 4, and π denotes a circular constant.

A relation between a ratio of the current penetration depth δ to the plate thickness tw of the material 1 to be rolled according to expression (1) and a heat generation density ratio of a plate surface to a plate thickness center part is shown in FIGS. 2 and 3.

A temperature distribution in a plate thickness direction before heating is such that the temperature of the plate surface is lower than that of the plate thickness center due to the influence of heat radiation.

Then, the heat generation density ratio of (plate surface)/(plate thickness center) is made 1.05 or lower, so that it becomes possible to appropriately heat the plate surface.

As a condition for causing this relation to be satisfied, from FIG. 3, it is appropriate to select such a frequency that the relation between the plate thickness tw of the material 1 to be rolled and the current penetration depth δ satisfies expression (2).

$$\frac{tw}{\delta} < 0.95 \tag{2}$$

In the steel hot-rolling line, the specific resistance ρ of the material 1 to be rolled, which is processed at a specified heating temperature, is approximately 120 μΩ-cm and the specific magnetic permeability is 1.

Accordingly, when the heating frequency with respect to the plate thickness tw of the material 1 to be rolled is set to be an appropriate heating frequency lower than 439 Hz at tw=25 mm, 305 Hz at tw=30 mm, or 171 Hz at tw=40 mm, the excessive temperature rise of the plate surface is prevented and heating can be performed.

Figure 4:
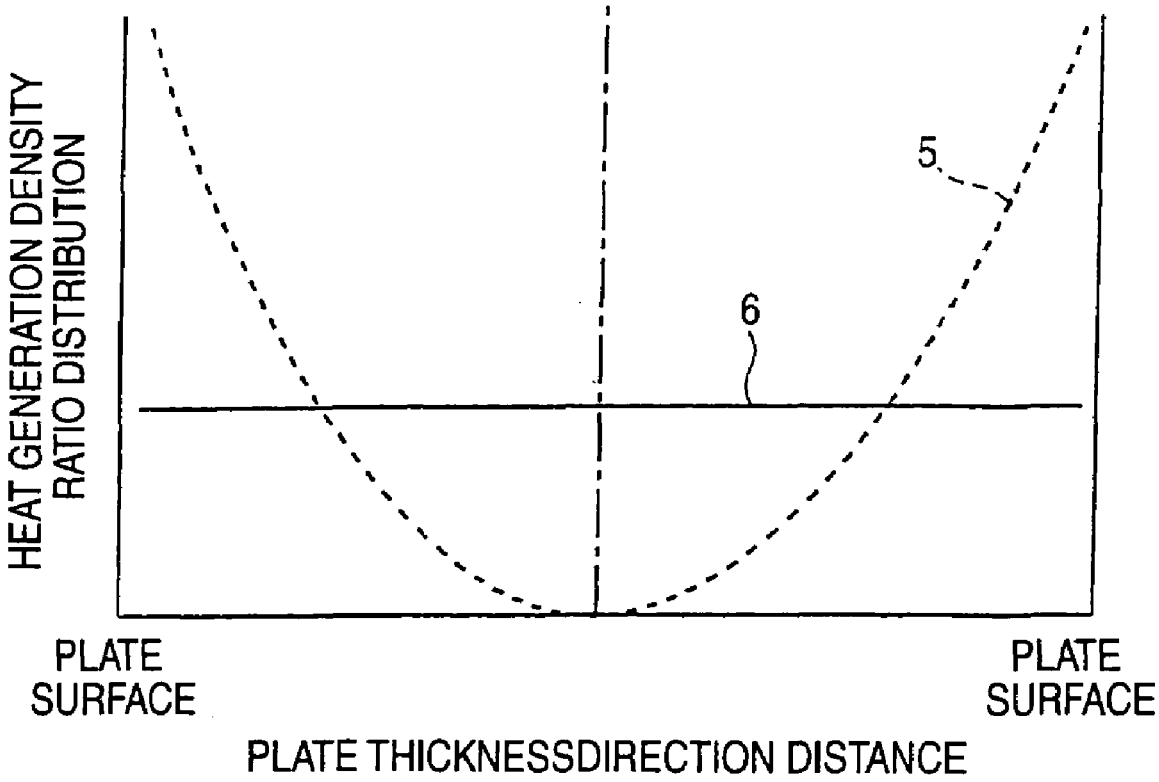
FIG. 4 is a graph showing heat generation density distributions of a transverse heater and a solenoid heater in a plate thickness direction.

FIG. 4 is a graph showing heat generation density distributions of a transverse heating apparatus and a solenoid heating apparatus in a plate thickness direction.

In the solenoid heating apparatus, as indicated by a characteristic 5, the heat generation density theoretically becomes 0 at the plate thickness center, and the heat generation is concentrated on the plate surface.

On the other hand, in the transverse heating apparatus, as indicated by a characteristic 6, the heat generation distribution can be made almost uniform by selecting an appropriate frequency.

In embodiment 1, although the description has been given for the case where one pair (one set) of inductors 2 and 3 are disposed on the plate width center line of the material 1 to be rolled, when plural pairs of inductors 2 and 3 are disposed in the traveling direction of the material 1 to be rolled 1 at the same positions in the plate width direction or positions shifted right and left, heating can be performed with an optimum heating pattern corresponding to the material 1 to be rolled, which varies in plate width.

Besides, in embodiment 1, although the description has been given to the case where each of the inductors 2 and 3 has one magnetic pole, even when two or more poles are provided, the same effect can be expected.

Further, in embodiment 1, although the description has been given to the case where the AC power source 4 generates the high frequency power, even when it is a commercial frequency power source of 50 Hz or 60 Hz, expression (2) can be satisfied.

Embodiment 2

Figure 5A:
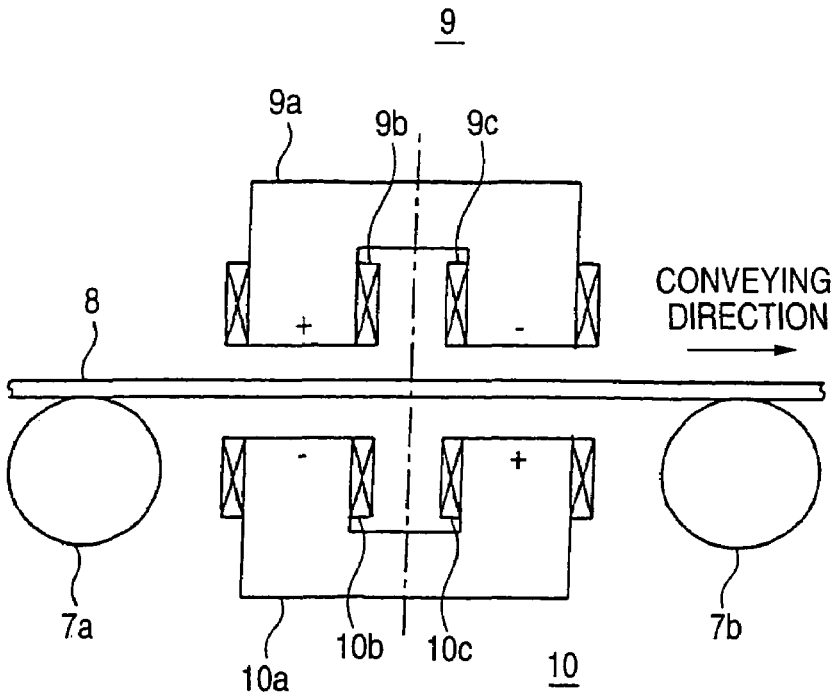
FIG. 5A is a structural view of a transverse induction heating apparatus according to embodiment 2 of this invention.

FIG. 5A is a structural view of a transverse induction heating apparatus according to embodiment 2 of this invention.

In FIG. 5A, a material 8 to be rolled is conveyed by conveying rolls 7*a* and 7*b* between a rough rolling mill of a steel hot-rolling line (not shown) and a finish rolling mill (not shown).

A pair of inductors 9 and 10 each including two (plural) magnetic poles are disposed to be opposite to each other across the material 8 to be rolled.

The inductors 9 and 10 are respectively constructed of iron cores 9*a* and 10*a* whose iron core widths in the plate width direction of the material 8 to be rolled are smaller than the plate width of the material 8 to be rolled, and coils 9*b*, 9*c*, 10*b* and 10*c* wound around the magnetic poles.

High frequency electric power is supplied from an AC power source (not shown) to the respective coils 9*b*, 9*c*, 10*b* and 10*c*, and the material 8 to be rolled is induction heated by magnetic fluxes generated by the magnetic poles of the respective iron cores 9*a* and 10*a*.

Similarly to embodiment 1, the iron core width of the inductor 9, 10 is made not larger than a value obtained by subtracting 300 mm from the plate width of the material 8 to be rolled, and the iron cores 9*a* and 10*a* are disposed on the plate width center line of the material 8 to be rolled.

Figure 5B:
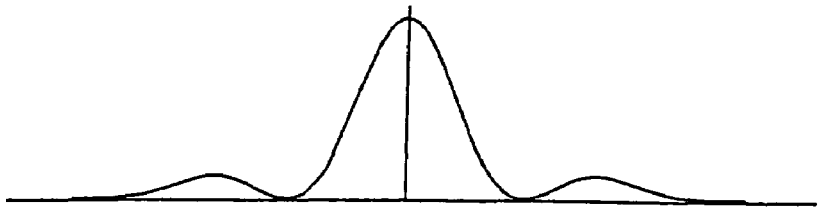
FIG. 5B is a temperature distribution graph.
Figure 5C:
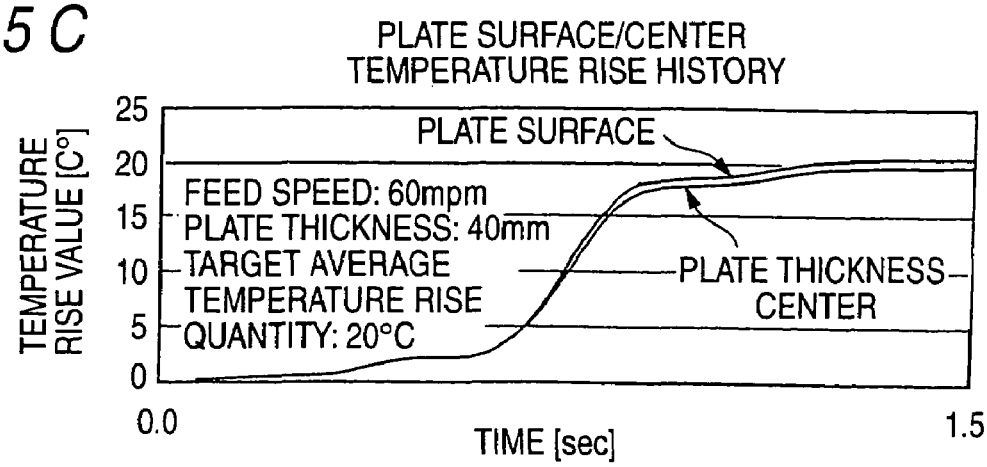
FIG. 5C is a graph of temperature rise as a function of time.

In the structure as stated above, when heating is performed under such setting conditions that the frequency (that is, heating frequency) of the AC power source (not shown) is 150 Hz, the plate thickness of the material 8 to be rolled is 40 mm, a conveying speed is 60 mpm, and an average temperature rise quantity is 20° C., as shown in FIG. 5C, the temperatures of the plate surface under heating and the plate thickness center are almost equally raised.

Here, in a solenoid induction heating apparatus, when a material to be rolled is heated by a solenoid coil under the same conditions as those of the transverse heating apparatus, during a period in which the material to be rolled is passing through the solenoid coil, a temperature rise hardly occurs at the plate thickness center, and the temperature of the plate surface is significantly raised. The plate surface instantly comes to have an excessive temperature rise of 52° C. about 2.6 times as high as the average temperature rise value of 20° C.

As shown in FIG. 5B, the heat generation distribution of the material 8 to be rolled is extended from a part opposite to the inductors 9 and 10, and according to circumstances, it reaches up to the conveying rolls 7*a* and 7*b* disposed before and after the inductors 9 and 10.

Thus, there is a possibility that a current flowing in the material 8 to be rolled generates a spark at a contact point with the conveying rollers 7*a* and 7*b*.

In order to prevent this, the surfaces of the conveying rolls 7*a* and 7*b* are coated with an electrical insulating member such as, for example, a ceramic paint to prevent the current flowing in the material 8 to be rolled from flowing to the conveying rolls 7*a* and 7*b*.

Figure 6:
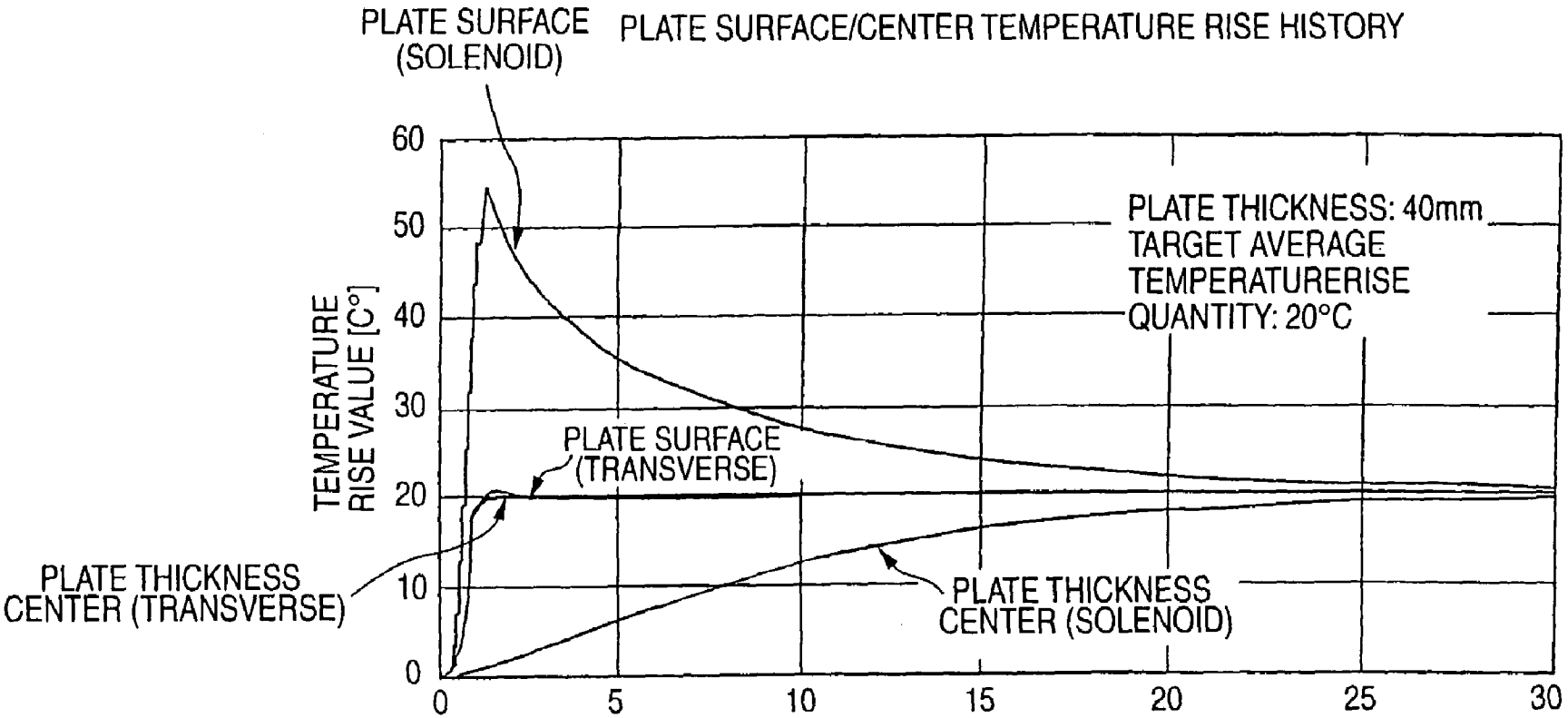
FIG. 6 is a graph showing plate temperature histories for transverse heating apparatus and solenoid heating apparatus before and after heating.

FIG. 6 is a graph showing plate temperature histories before and after heating by a transverse heating apparatus and a solenoid heating apparatus.

In the solenoid heating apparatus, it takes 20 seconds or more at a conveying speed of 60 mpm, 20 m in terms of a distance, for a plate surface and a plate thickness center to converge to a temperature rise setting temperature of 20° C.

On the other hand, in the transverse heating apparatus, the temperature rises converge within several seconds.

Embodiment 3

Figure 7B:
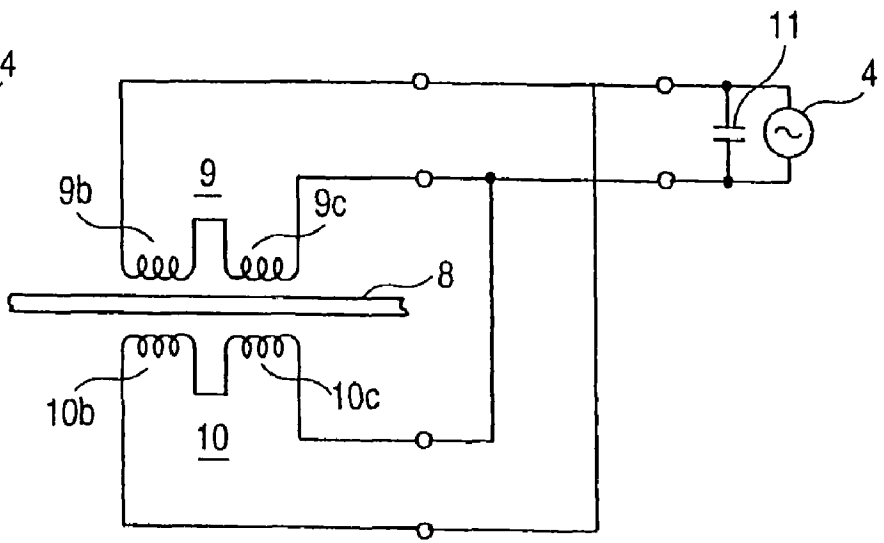
FIGS. 7A and 7B are explanatory views showing coil connections of a transverse induction heating apparatus according to embodiment 3 of this invention.
Figure 7A:
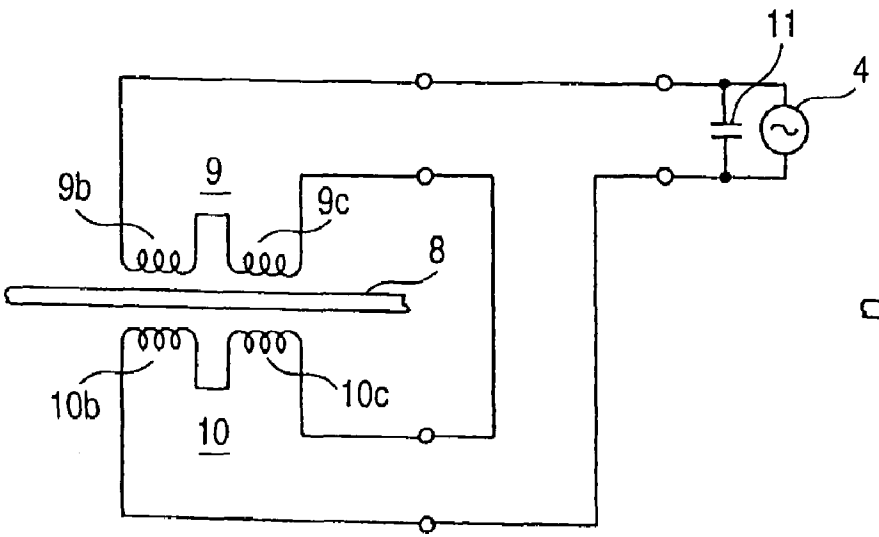

FIGS. 7A and 7B are explanatory views showing coil connections of a transverse induction heating apparatus according to embodiment 3 of this invention.

In FIGS. 7A and 7B, an AC power source 4 is the same as that of embodiment 1, and a material 8 to be rolled and inductors 9 and 10 are the same as those of embodiment 2.

In FIG. 7A, coils 9*b*, 9*c*, 10*b* and 10*c* of the respective inductors 9 and 10 are connected in series to each other, and are connected to the AC power source 4 and a matching capacitor 11.

Besides, in FIG. 7B, coils 9*b* and 9*c* of the inductor 9 disposed at the upper side of the material 8 to be rolled are connected in series to each other, and coils 10*b* and 10*c* of the inductor 10 disposed at the lower side are connected in series to each other.

Then, the upper coils 9*b* and 9*c* relative to the material 8 to be rolled and the lower coils 10*b* and 10*c* are connected in parallel to the AC power source 4.

As shown in FIG. 7A, in the case where all of the coils 9*b*, 9*c*, 10*b* and 10*c* of the inductors 9 and 10 are connected in series to each other, even if the inductors 9 and 10 are not disposed symmetrically above and below the material 8 to be rolled, the currents flowing to all the coils 9*b*, 9*c*, 10*b* and 10*c* become equal to each other, and electric losses of the respective inductors 9 and 10 become equal to each other.

On the other hand, as shown in FIG. 7B, in the case where the coils 9*b* and 9*c* of the inductor 9 and the coils 10*b* and 10*c* of the inductor 10 are connected in parallel, the impedance of a coil at the side close to the material 8 to be rolled becomes small and a large current flows, so that the electric loss of the inductor at the side close to the material 8 to be rolled becomes large.

Figures 8A, 8B, 8C:
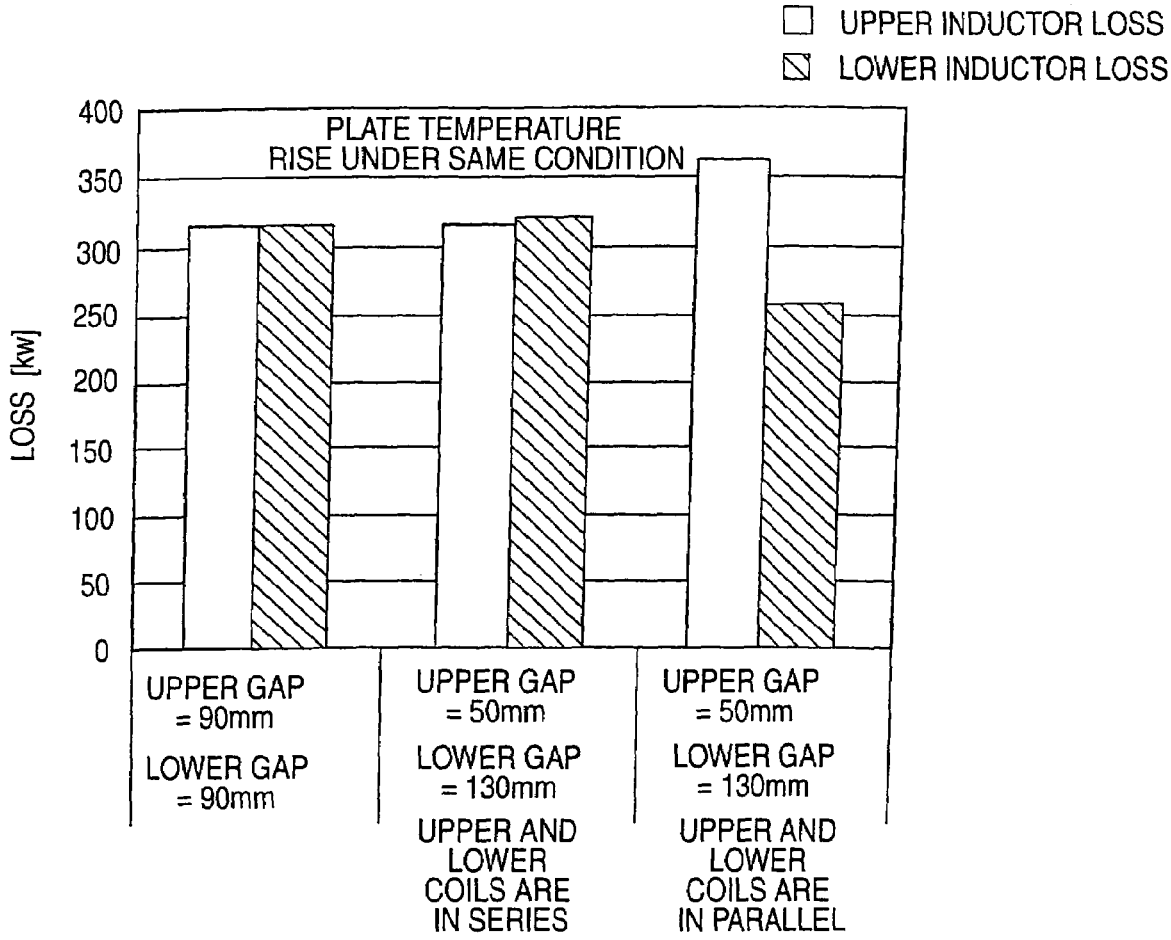
FIGS. 8A, 8B, and 8C are graphs showing electrical losses with respect to a gap between a material to be rolled and an iron core of an upper inductor and a gap between the material and an iron core of a lower inductor as in FIGS. 7A and 7B.

FIGS. 8A, 8B, and 8C are graphs showing electric losses with respect to gaps between the material 8 to be rolled and the iron core of the upper inductor 9 and between the material and the iron core of the lower inductor 10.

In FIG. 8A, the gaps between the upper and lower inductors 9 and 10 and the material 8 to be rolled are 90 mm and are equal to each other. FIG. 8B shows a case where the gap between the iron core of the upper inductor 9 and the material 8 to be rolled is 50 mm, the gap between the iron core of the lower inductor 10 and the material 8 to be rolled is 130 mm, and the connection of the coils 9*b*, 9*c*, 10*b* and 10*c* is as shown in FIG. 7A. FIG. 7C shows a case where the gaps between the upper and lower inductors 9 and 10 and the material 8 to be rolled are the same as those of FIG. 8B, and the coils 9*b* and 9*c* and the coils 10*b* and 10*c* are connected in parallel and as shown in FIG. 7B.

FIGS. 8A–8C show cases where a comparison was made under conditions that the average temperature rise quantities of the material 8 to be rolled become equal to each other in all cases.

In the case where the gaps between the iron cores 9*a* and 10*a* of the upper and lower inductors 9 and 10 and the material 8 to be rolled are equal to each other, as shown in FIG. 8A, the electric losses of the respective inductors 9 and 10 *a* are equal to each other.

On the other hand, as shown in FIG. 7A, in the case where the upper coils 9*b* and 9*c* and the lower coils 10*b* and 10*c* are connected in series to each other, even if the inductors 9 and 10 are not disposed symmetrically with respect to the material 8 to be rolled, since the currents flowing to all the coils 9*b*, 9*c*, 10*b* and 10*c* are equal to each other, the electric losses of the inductors 9 and 10 are almost equal to each other.

Besides, as shown in FIG. 7B, in the case where the upper coils 9*b* and 9*c* and the lower coils 10*b* and 10*c* are connected in parallel to each other, as shown in FIG. 8C, the loss at the upper inductor 9 in which the gap is small becomes large, and the loss becomes larger than that of the case of the connection as shown in FIG. 7A.

As stated above, when the upper coils 9*b* and 9*c* and the lower coils 10*b* and 10*c* are connected in parallel to each other, a large current flows to the coils 9*b* and 9*c* at the side close to the material 8 to be rolled, the electric loss of the inductor 9 at the close side becomes large, and cooling capacity for the coil becomes insufficient, and therefore, there is a possibility that the current which can be made to flow to the coil is limited, and the temperature rise value of the material 8 to be rolled is limited.

On the other hand, as shown in FIG. 7A, when all the coils 9*b*, 9*c*, 10*b* and 10*c* are connected in series to each other, the electric losses of the inductors 9 and 10 can be made almost equal to each other.

Embodiment 4

Figure 9:
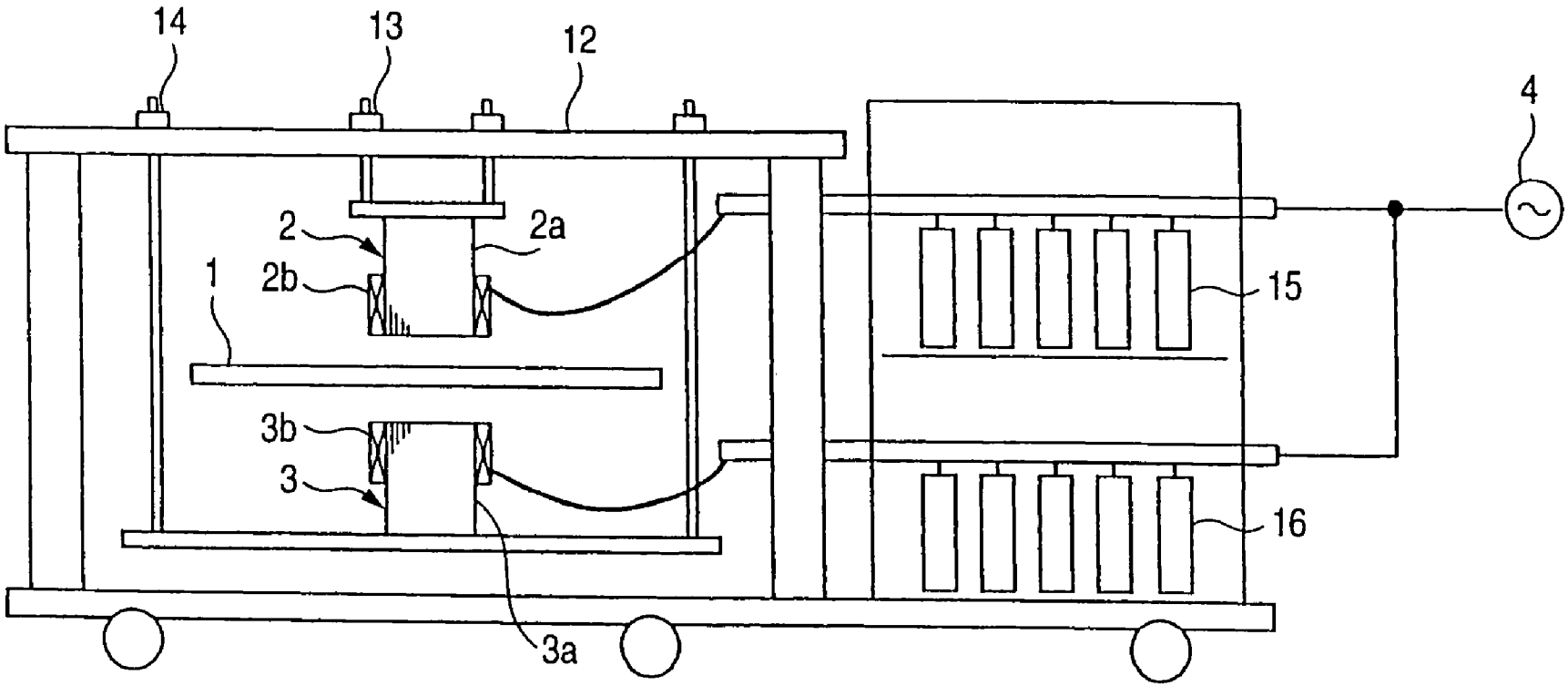
FIG. 9 is a structural view showing embodiment 4 of this invention.

FIG. 9 is a structural view showing embodiment 4 of this invention. In FIG. 9, a material 1 to be rolled, inductors 2 and 3, and an AC power source 4 are the same as those of embodiment 1.

In FIG. 9, a truck 12 which can move in a plate width direction of the material 1 to be rolled is disposed. The respective inductors 2 and 3 are disposed on the truck 12 through lifting and lowering means 13 and 14 so as to be opposite to each other across the material 1 to be rolled, and they can be individually lifted and lowered.

Coils 2*a* and 3*a* of the inductors 2 and 3 are connected to the AC power source 4 through matching capacitors 15 and 16 disposed on the truck 12. Incidentally, the matching capacitors 15 and 16 may be installed to be separated from the truck 12.

In the transverse type induction heating apparatus constructed as stated above, the inductors 2 and 3 disposed above and below the material 1 to be rolled are lifted and lowered by the lifting and lowering means 13 and 14, so that the gaps between the respective inductors 2 and 3 and the material 1 to be rolled can be arbitrarily adjusted.

Figure 10:
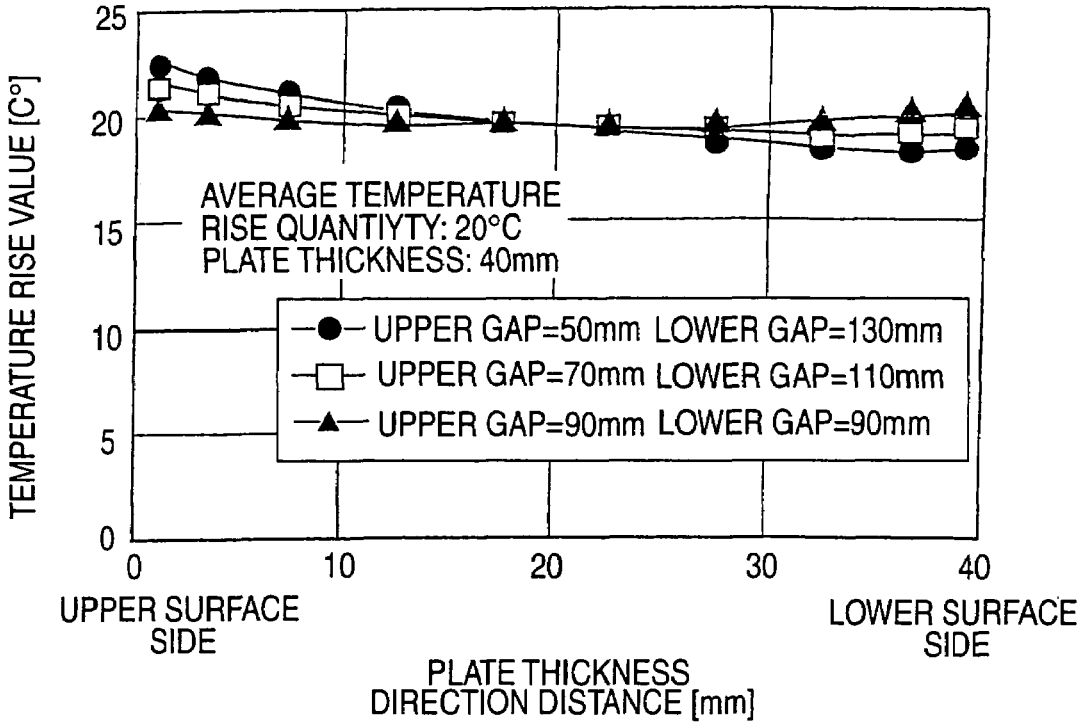
FIG. 10 is a graph showing temperature rise distributions in a plate thickness direction in a case where a gap between a material to be rolled and an iron core of an inductor is changed.

FIG. 10 is a graph showing temperature rise distributions in the plate thickness direction in a case where gaps between the material 1 to be rolled and the iron cores 2*a* and 3*a* of the inductors 2 and 3 disposed above and below are changed.

When the upper and lower gaps are different from each other, irrespective of whether the upper and lower coils 2*b* and 3*b* are connected in series or in parallel, there is a tendency that the temperature rise of a plate surface at a small gap side becomes large.

Figure 11:
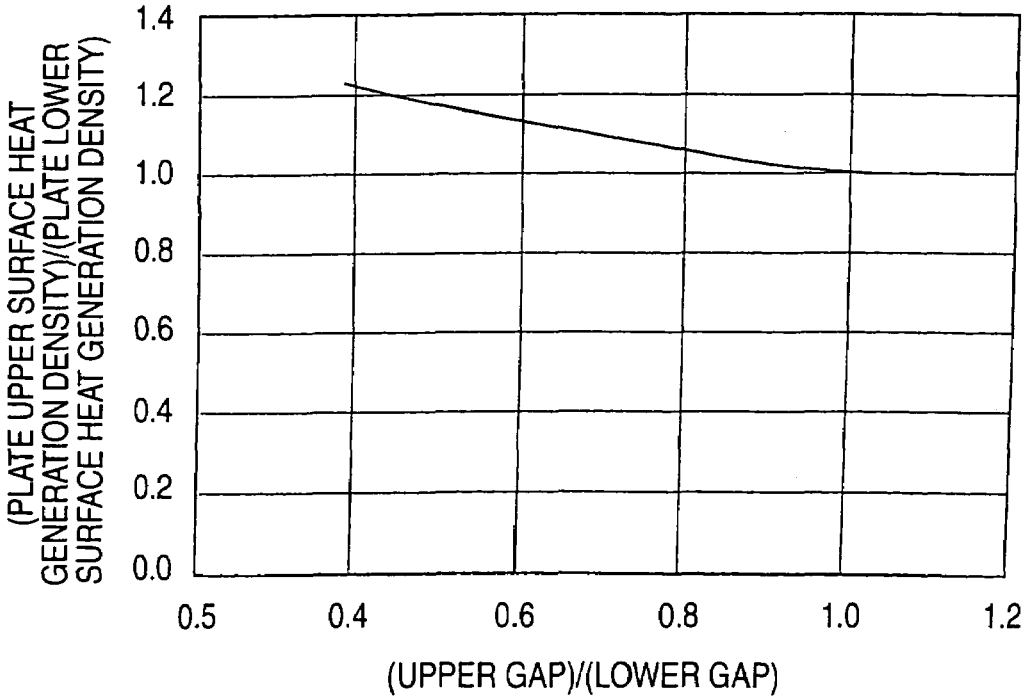
FIG. 11 is a graph showing a ratio of (plate upper surface heat generation density)/(plate lower surface heat generation density) with respect to a ratio of (upper gap)/(lower gap).

FIG. 11 is a graph showing a ratio of (plate upper surface heat generation density)/(plate lower surface heat generation density) with respect to a ratio of (upper gap)/(lower gap).

In FIG. 11, when the upper and lower gaps are different from each other, the temperature rise of the plate surface at the small gap side becomes large.

As stated above, in the case where the upper and lower gaps are different from each other, since the temperature rise varies in the thickness direction of the material 1 to be rolled, according to the plate thickness of the material 1 to be rolled, the positions of the respective inductors 2 and 3 are adjusted by the lifting and lowering means 13 and 14 so that the upper and lower gaps become equal to each other, and consequently, the temperature rises at the plate upper and lower surfaces can be made coincident with each other.

With respect to the temperature distribution in the plate thickness direction of the material 1 to be rolled before it passes through between the inductors 2 and 3, there is a tendency that the temperature of the material 1 to be rolled at the lower surface side is lower than that at the upper surface side due to a state of burning by gas heating in a heating furnace, heat release to a skid rail (not shown) for supporting the material 1 to be rolled, heat release to the conveying roll (not shown) in the middle of conveyance after extraction from the heating furnace, or the like.

There is a possibility that the temperature difference between the upper and lower surfaces of the material 1 to be rolled influences unevenness in qualities of plates and machine workability.

However, according to the above structure, the upper and lower inductors 2 and 3 are lifted or lowered by the lifting and lowering means 12 and 13 to adjust the gaps between the respective inductors 2 and 3 and the material 1 to be rolled, and the lower gap is made smaller than the upper gap, so that the temperature rise of the plate lower surface can be made higher than that of the plate upper surface, and accordingly, the upper and lower surfaces of the plate can be made to have equal temperature.

Embodiment 5

Figure 12A:
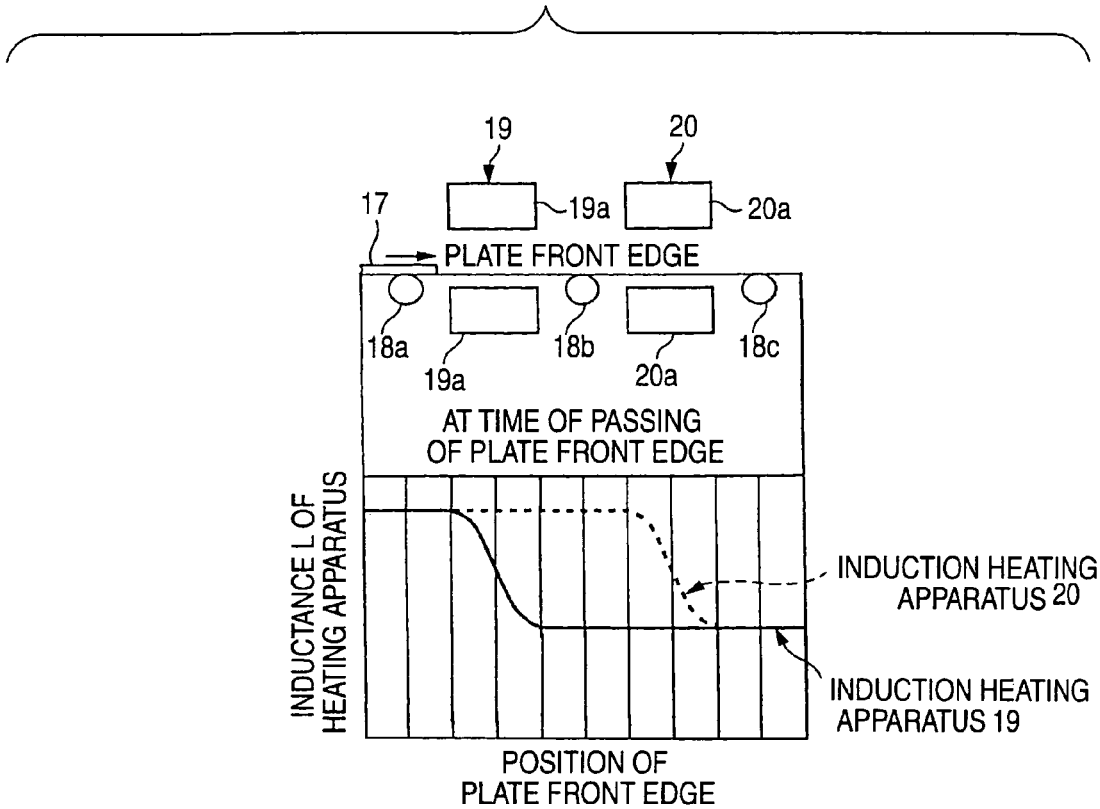
FIGS. 12A and 12B are explanatory views according to embodiment 5 of this invention.
Figure 12A:
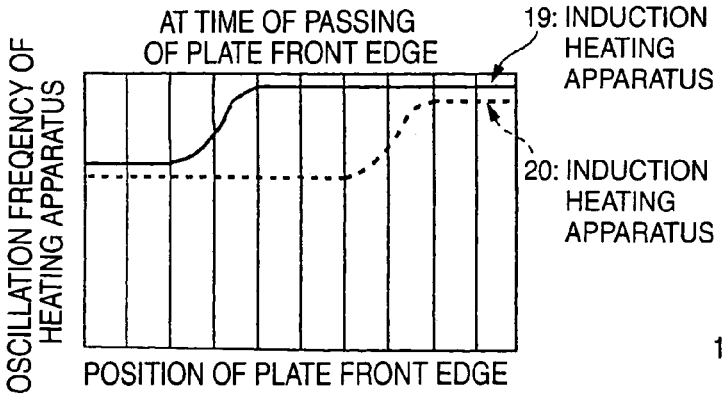
Figure 12B:
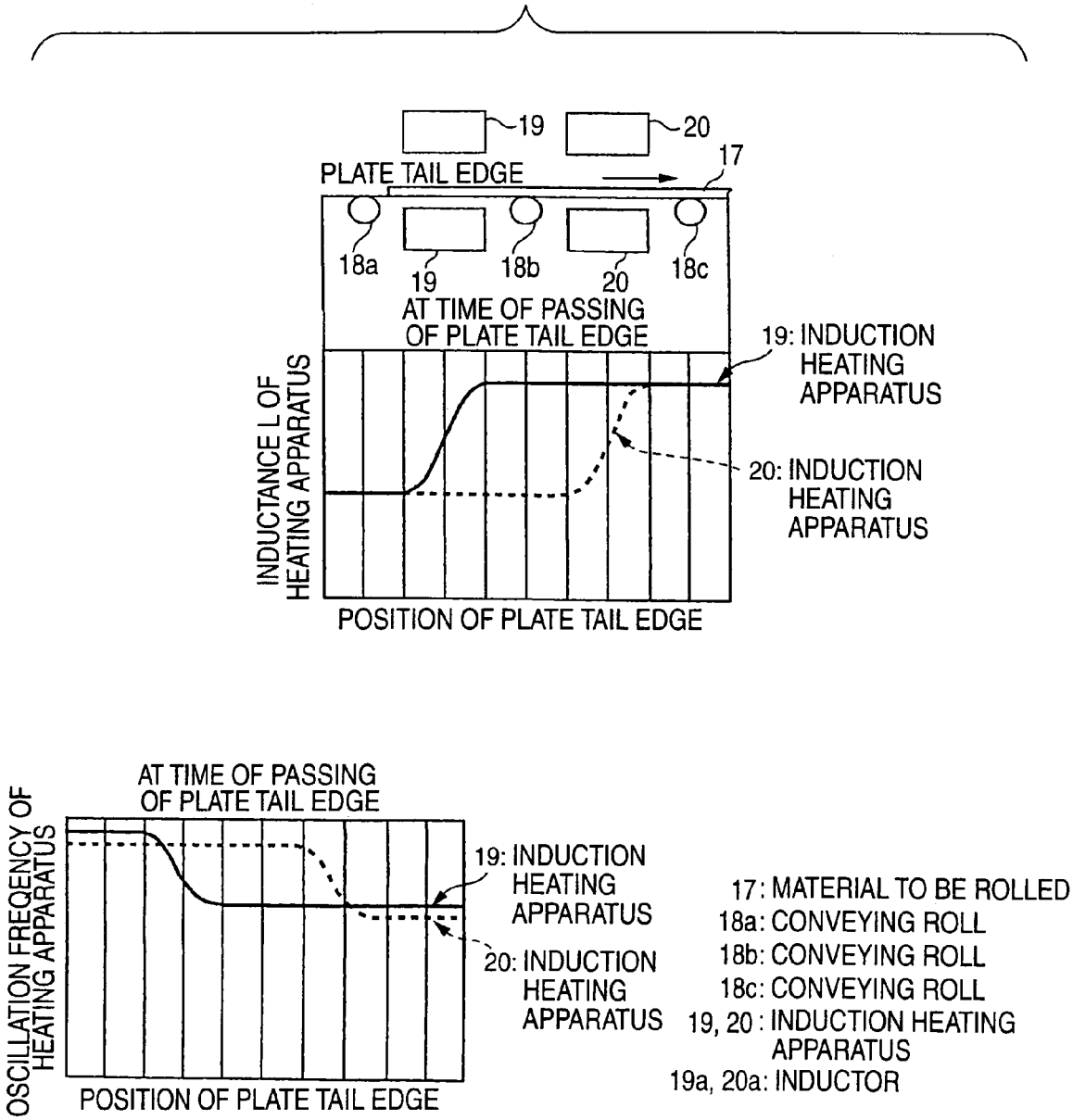

FIGS. 12A and 12B are explanatory views according to embodiment 5 of this invention, in which plural transverse induction heating apparatuses are installed in a traveling direction of a material to be rolled.

FIG. 12A shows a state at the time of passing of the front edge of a plate, and FIG. 12B shows a state at the time of passing of the tail edge of the plate.

In FIGS. 12A and 12B, a material 17 to be rolled is conveyed by conveying rolls 18*a* to 18*c* from the left in the drawing to the right in the drawing. Induction heating apparatuses 19 and 20 are disposed from the upstream side of a line in the traveling direction of the material 17 to be rolled.

The induction heating apparatuses 19 and 20 respectively include individual AC power sources (not shown). A frequency of the AC power source (not shown) connected to the induction heating apparatus 19 at the line upstream side is made F1, and a frequency of the AC power source (not shown) connected to the induction heating apparatus 20 at the line downstream side is made F2.

Further, when an nth AC power source (not shown) from the upstream side is made Fn, and K is made 1.05 to 1.20, the frequencies of the upstream side AC power source (not shown) and the downstream side AC power source (not shown) are set to satisfy expression (3).

$$F1>F2\times K>\ldots>Fn\times k^{n-1} \quad (3)$$

In the transverse type induction heating apparatus, in a no-load state in which the material 17 to be rolled does not exist between the upper and lower inductors 19*a* and 20*a*, the impedance becomes large, and accordingly, in the case where an inverter operating in accordance with the resonant frequency of a load is used as the AC power source, as shown in FIGS. 12A and 12B, the frequency becomes lower than that at the load time.

The material 17 to be rolled is conveyed from the upstream side and when the front edge part passes through the inductors 19*a* and 20*a*, in case the heating frequency of the upstream side induction heating apparatus 19 is set to be lower than the heating frequency of the downstream side induction heating apparatus 20, the heating frequency of the induction heating apparatus 19 after passing of the plate front edge and that of the downstream induction heating apparatus 20 under passing of the plate front edge coincide with each although instantly.

Thus, a magnetic interference occurs between the adjacent induction heating apparatuses 19 and 20, and there is a possibility that heating temperature does not become stable, or the power source trips.

However, when the frequency of the AC power source (not shown) at the line upstream side is made higher than the frequency of the AC power source (not shown) at the downstream side, it is possible to prevent the power source from tripping after the plate front edge of the material 17 to be rolled has passed through the upstream side induction heating apparatus 19.

EFFECTS OF THE INVENTION

According to this invention, the iron core width of the inductor in the plate width direction of the material to be rolled is made smaller than the plate width of the material to be rolled, it is disposed on the plate width center line of the material to be rolled, and the heating frequency is selected so that the current penetration depth δ of the expression (1) satisfies the expression (2), and therefore, the center part of the material to be rolled in the longitudinal direction is continuously heated, and heating can be performed while the temperature of the plate surface is not excessively raised.

INDUSTRIAL APPLICABILITY

This invention is useful for realizing a transverse type induction heating apparatus in which the centre part of a material to be rolled in the longitudinal direction is continuously heated, and heating can be performed without causing excessive temperature rise of the plate surface of the material to be rolled.

The invention claimed is:

1. A transverse induction heating apparatus comprising:

inductors including iron cores and coils wound around the iron cores, disposed between a rough rolling mill and a finish rolling mill of a steel hot-rolling line, opposite to each other on opposite sides of a material to be rolled and conveyed by a conveying roll, the material being heated by the inductors to which electric power is supplied from an AC power source, wherein, iron core widths of the inductors in a plate width direction of the material to be rolled are smaller than the plate width of the material to be rolled, the inductors are disposed on a plate width center line of the material to be rolled, and, when current penetration depth is δ(m), specific resistance of the material to be rolled is ρ(Ω-m), magnetic permeability of the material to be rolled is μ(H/m), frequency of the AC power source is f (Hz), and plate thickness of the material to be rolled is tw (m), $$\delta = \sqrt{\frac{\rho}{\mu \cdot f \cdot \pi}} \text{ and } \frac{tw}{\delta} < 0.95.$$

2. The transverse induction heating apparatus according to claim 1, wherein the inductors include plural magnetic poles.

3. The transverse induction heating apparatus according to claim 2, wherein respective coils are connected in series to each other.

4. The transverse induction heating apparatus according to claim 2, including lifting and lowering means for adjusting respective inductors in a plate thickness direction of the material to be rolled.

5. The transverse induction heating apparatus according to claim 2, including at least two pairs of the inductors disposed in a traveling direction of the material to be rolled, wherein the conveying roll is disposed between the inductors.

6. The transverse induction heating apparatus according to claim 5, wherein the iron core of each of the inductors is disposed on the plate width center line of the material to be rolled.

7. The transverse induction heating apparatus according to claim 6, wherein the at least two pairs of the inductors are disposed from an upstream side to a downstream side of the steel hot-rolling line, and including a plurality of AC power sources individually connected to respective inductors, wherein frequencies of the AC power sources are F1, F2, . . . Fn from an upstream side of the steel hot-rolling line, K=1.05 to 1.20, and the frequencies of the respective AC power sources satisfy $$F1>F2\times K> \ldots >Fn\times K^{n-1}.$$

8. The transverse induction heating apparatus according to claim 5, wherein a surface of the conveying roll is coated with an electrically insulating member.

9. The transverse induction heating apparatus according to claim 1, wherein respective coils are connected in series to each other.

10. The transverse induction heating apparatus according to claim 9, including lifting and lowering means for adjusting respective inductors in a plate thickness direction of the material to be rolled.

11. The transverse induction heating apparatus according to claim 1, including lifting and lowering means for adjusting respective inductors in a plate thickness direction of the material to be rolled.

12. The transverse induction heating apparatus according to claim 1, including at least two pairs of the inductors disposed in a traveling direction of the material to be rolled, wherein the conveying roll is disposed between the inductors.

13. The transverse induction heating apparatus according to claim 12, wherein the iron core of each of the inductors is disposed on the plate width center line of the material to be rolled.

14. The transverse induction heating apparatus according to claim 12, wherein a surface of the conveying roll is coated with an electrically insulating member.

15. The transverse induction heating apparatus according to claim 1, wherein the at least two pairs of the inductors are disposed from an upstream side to a downstream side of the steel hot-rolling line, and including a plurality of AC power sources individually connected to respective inductors, wherein frequencies of the AC power sources are F1, F2, . . . Fn from an upstream side of the steel hot-rolling line, K=1.05 to 1.20, and the frequencies of the respective AC power sources satisfy $$F1>F2\times K> \ldots >Fn\times K^{n-1}.$$

* * * * *